US009260262B2

(12) United States Patent
Matsumoto et al.

(10) Patent No.: US 9,260,262 B2
(45) Date of Patent: Feb. 16, 2016

(54) SHEET STACKING APPARATUS, SHEET FEEDING APPARATUS AND IMAGE FORMING APPARATUS

(71) Applicant: CANON KABUSHIKI KAISHA, Tokyo (JP)

(72) Inventors: Yasuaki Matsumoto, Susono (JP); Masaki Iwase, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/595,339

(22) Filed: Jan. 13, 2015

(65) Prior Publication Data

US 2015/0203311 A1 Jul. 23, 2015

(30) Foreign Application Priority Data

Jan. 17, 2014 (JP) ..... 2014-006947

(51) Int. Cl.
*B65H 9/06* (2006.01)
*B65H 1/04* (2006.01)
*B65H 31/34* (2006.01)

(52) U.S. Cl.
CPC .. *B65H 9/06* (2013.01); *B65H 1/04* (2013.01); *B65H 31/34* (2013.01)

(58) Field of Classification Search
CPC ..... B65H 1/00; B65H 1/04; B65H 31/00; B65H 31/20; B65H 31/34; B65H 2404/721; B65H 2405/112; B65H 2405/1122; B65H 9/06; B65H 9/00
USPC ..... 271/145, 171, 207, 220, 223, 224, 241
See application file for complete search history.

(56) References Cited

U.S. PATENT DOCUMENTS 5,535,012 A 7/1996 Matsumoto et al.
5,580,045 A 12/1996 Matsumoto et al.
6,021,305 A 2/2000 Sato et al.
6,131,898 A 10/2000 Hiroi et al.
6,246,491 B1 6/2001 Matsumoto et al.
6,471,429 B1 10/2002 Isobe et al.
6,473,590 B2 10/2002 Matsumoto et al.
6,493,113 B1 12/2002 Fujii et al.
6,826,374 B2 11/2004 Kato et al.
6,871,042 B2 3/2005 Nemura et al.
6,904,261 B2 6/2005 Fujii et al.
6,963,722 B2 11/2005 Matsumoto et al.
7,095,978 B2 8/2006 Matsumoto et al.
7,568,691 B2 8/2009 Matsumoto
7,607,657 B2 * 10/2009 Kawarago ..... B65H 1/04 271/171
7,823,875 B2 11/2010 Fukatsu et al.
8,167,296 B2 5/2012 Matsumoto
8,417,174 B2 * 4/2013 Yamazaki ..... B65H 1/04 271/145
8,500,114 B2 8/2013 Matsumoto et al.
8,702,093 B2 * 4/2014 Hirahara ..... B65H 1/00 271/127
8,770,578 B2 * 7/2014 Yamamoto ..... B65H 1/266 271/171
2010/0052247 A1 * 3/2010 Kaseda ..... B65H 1/266 271/226

FOREIGN PATENT DOCUMENTS

EP 1413533 A1 4/2014
JP 09-118439 A 5/1997
JP 09309628 A 12/1997
JP 2005145706 A 6/2005

OTHER PUBLICATIONS

GB Search Report issued in corresponding Application GB1500629.9 dated Jul. 17, 2015.

* cited by examiner

*Primary Examiner* — David H Bollinger
(74) *Attorney, Agent, or Firm* — Fitzpatrick, Cella, Harper & Scinto

(57) ABSTRACT

A sheet stacking apparatus has an abutment portion attached to a holding portion movably in first and second directions. The abutment portion is configured such that a movable range of the abutment portion is restricted by a second restricting portion from a first movable range in a state in which the move of the holding portion is restricted by the first restricting portion to a second movable range in a state in which the restriction on of the holding portion is released by the releasing portion. The movable range of the second movable range is narrower than a movable range of the first movable range.

15 Claims, 7 Drawing Sheets

SHEET STACKING APPARATUS, SHEET FEEDING APPARATUS AND IMAGE FORMING APPARATUS

BACKGROUND OF THE INVENTION

1. Field of the Invention

The present invention relates to a sheet stacking apparatus configured to stack a sheet, a sheet feeding apparatus, and an image forming apparatus.

2. Description of the Related Art

Conventionally, an image forming apparatus such as a printer and a copier includes a sheet feeding apparatus including a sheet feeding cassette, i.e., an sheet stacking apparatus, configured to be able to store (stack) a large number of sheets, and a feed roller for feeding the sheets stored in the sheet feeding cassette one by one to an image forming portion of the image forming apparatus. In general, such sheet feeding cassette is provided with a rear end restricting portion restricting a rear end, i.e., an upstream end in a sheet feeding direction in which the sheet is fed of the sheet, and a side end restricting portion restricting a widthwise position orthogonal to the sheet feeding direction of the sheet.

Here, Japanese Patent Application Laid-open No. H09-118439, for example, discloses a sheet feeding cassette including a press member provided in the rear end restricting portion and biased toward the sheet rear end by a biasing portion to position a front end of the sheet to a position where the sheet can be in contact with a sheet feeding roller.

The press member reliably abuts against the rear end of the sheet and a rear end position of the sheet can be thus accurately positioned by configuring such that the press member is biased to the rear end of the sheet as described above. However, there is a case where the rear end restricting portion is set downstream in the sheet feeding direction i.e., to a forward side of the cassette, of a normal position corresponding to a sheet size in trying to set the rear end restricting portion along the rear end of the sheet after placing a regular size sheets in the sheet feeding cassette. That is, there is a case where the rear end restricting portion is set while pushing the sheets placed in the sheet feeding cassette further without being locked at the position restricting the regular size sheet. In such a case, there is a possibility that the press member is pushed in while resisting against a bias force of the bias member and the rear end restricting portion is locked at the position where the press member is pushed in. In this case, the rear end of the sheet is pressed unnecessary by the rear end restricting portion and a front end of the sheet comes into pressure contact with a front wall surface of the sheet feeding cassette. That is, there arises a problem that the sheet is held tightly between the front wall surface of the sheet feeding cassette and the rear end restricting portion, causing a large friction force between the front end of the sheet and the sheet feeding cassette.

SUMMARY OF THE INVENTION

According to one aspect of the invention, a sheet feeding apparatus includes a sheet stacking member on which a sheet is stacked, and a sheet restricting portion configured to restrict a position of an end of the sheet stacked on the sheet stacking member, the sheet restricting portion including, a holding portion provided in the sheet stacking member, the holding portion being movably with respect to the sheet stacking member in a first direction and a second direction opposite to the first direction, a first restricting portion configured to determine a position of the holding portion in the first direction by restricting a move of the holding portion, a releasing portion configured to release the restriction of the holding portion made by the first restricting portion, an abutment portion attached to the holding portion, the abutment portion being movably with respect to the holding portion in the first and second directions and including an abutting surface abutting against the end of the sheet, a bias member configured to bias the abutment portion toward the first direction, and a second restricting portion configured to restrict a movable range of the abutment portion from a first movable range in a state in which the holding portion is restricted by the first restricting portion to a second movable range in a state in which the restriction of the holding portion is released by the releasing portion, a movable range in the second direction of the second movable range is narrower than a movable range in the second direction of the first movable range.

Further features of the present invention will become apparent from the following description of exemplary embodiments with reference to the attached drawings. The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Figure 1:
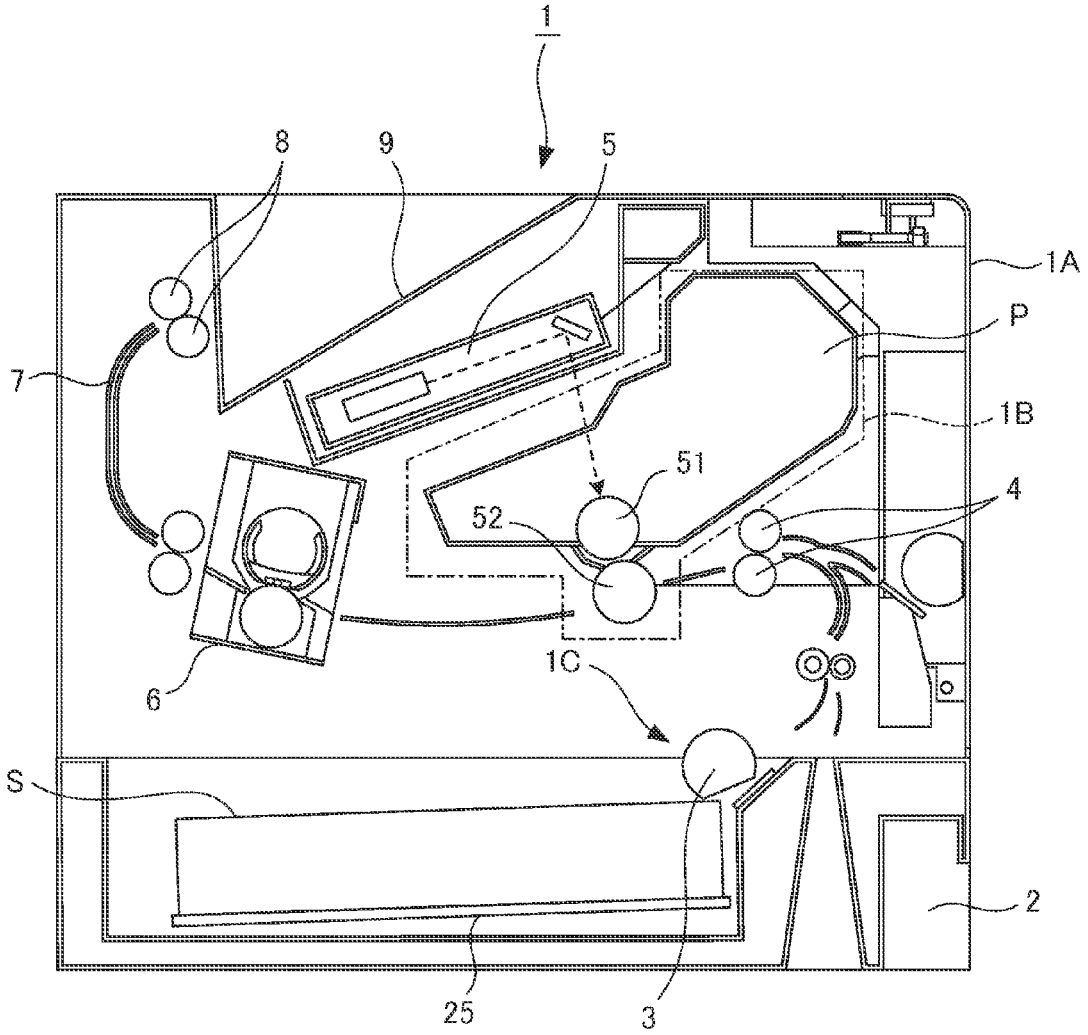
FIG. 1 is a schematic diagram illustrating a configuration of a sheet feeding apparatus and a laser beam printer as an image forming apparatus including the same.

Embodiments of the present invention will be explained in detail below with reference to the drawings. FIG. 1 is a schematic diagram schematically illustrating a configuration of a laser beam printer as an image forming apparatus including a sheet stacking apparatus and a sheet feeding apparatus of a first embodiment of the invention. As shown in FIG. 1, the laser printer 1 includes a laser printer body 1A (referred to as an 'apparatus body' hereinafter). The apparatus body 1A includes an image forming portion 1B and a sheet feeding apparatus 1C configured to feed a sheet to the image forming portion 1B.

Here, the image forming portion 1B includes a cartridge unit P including a photosensitive drum 51, i.e., an image carrier, and a laser scanner 5 exposing the photosensitive drum 51. In forming an image, the photosensitive drum 51 is exposed by the laser scanner 5 to form a latent image on a surface of the photosensitive drum 51 and then the latent image is developed to form a toner image on the surface of the photosensitive drum 51.

The sheet feeding apparatus 1C includes a sheet feeding cassette 2, i.e., the sheet stacking apparatus, provided drawably in/out of the apparatus body 1A, and a feed roller 3, i.e., an sheet feeding portion, provided above the sheet feeding cassette 2 and feeding a sheet S stored in the sheet feeding cassette 2. It is noted that the sheet feeding cassette 2 is provided with a middle plate 25, i.e., an exemplary sheet stacking portion described later, turnably in a vertical direction to press the sheet S against a feed roller side. That is, in the present embodiment, a cassette body 21 of the sheet feeding cassette 2 and the middle plate 25 compose a sheet stacking member on which the sheet is stacked, and the middle plate 25 is provided in a cassette body 21 of the sheet feeding cassette 2 such that the middle plate 25 is turnable in vertical direction toward the feed roller 3 and configured to stack the sheets to be fed to the feed roller 3 thereon. The middle plate 25 is kept at a position pressing the sheet S against the feed roller side in feeding the sheet by a lift mechanism not shown.

Then, the sheet feeding apparatus 1C constructed as described above delivers the sheet S stored in the sheet feeding cassette 2 by the feed roller 3 concurrently with a toner image forming operation of the image forming portion 1B described above. It is noted that the sheet S is then conveyed to a transfer portion formed by the photosensitive drum 51 and a transfer roller 52 at a predetermined timing adjusted by a registration roller pair 4. The toner image formed on the surface of the photosensitive drum 51 is transferred in the transfer portion to the sheet S conveyed thereto. After that, the sheet S is conveyed to a fixing unit 6 to fix the toner image on the sheet S by heat and pressure applied in the fixing unit 6. After fixing the image, the sheet S is discharged by a sheet discharge roller 8 to a discharge portion 9 provided at an upper surface of the ab.

Figure 2:
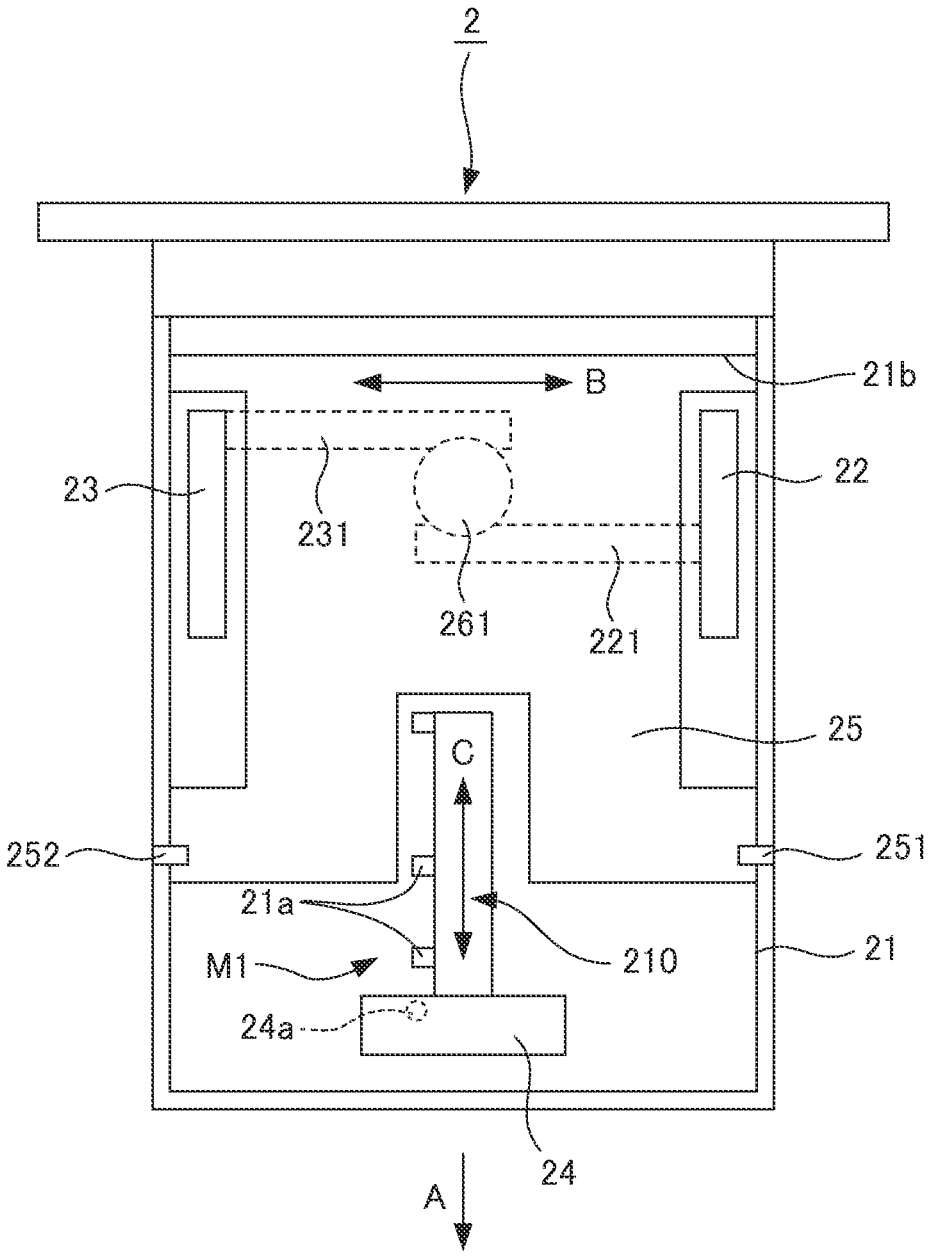
FIG. 2 is a first diagram illustrating a configuration of a sheet feeding cassette provided in the sheet feeding apparatus.

As shown in FIG. 2, the sheet feeding cassette 2 includes the cassette body 21, i.e., an storage body, loading and storing the sheets S of various sizes and a pair of side end restricting members 22 and 23 restricting positions in a width direction orthogonal to the sheet feeding direction of the sheets S stored in the cassette body 21. The sheet feeding cassette 2 also includes a rear end restricting member 24, i.e., a sheet restricting portion, restricting a rear end position, i.e., an upstream end in the sheet feeding direction/a position of an end of the sheet, of the sheets S. The side end restricting members 22 and 23 and the rear end restricting member 24 are supported on a bottom upper surface of the cassette body 21 movably respectively in the width direction orthogonal to the sheet feeding direction and in the sheet feeding direction. It is noted that in the present embodiment, the sheet feeding direction will be referred to also as a first direction and a direction opposite from the sheet feeding direction will be referred to as a second direction. There is also a case where these first and second directions are referred to collectively as the sheet feeding direction. Still further, an upstream side in each of these first and second directions will be also referred to as 'rearward' and a downstream side as 'forward'.

The cassette body 21 is provided with the middle plate 25 described above turnably in the vertical direction centering on middle plate spindles 251 and 252. An elastic member 26 such as a spring is disposed between the cassette body 21 and the middle plate 25 (see FIG. 3) such that the elastic member 26 biases the middle plate 25 upward. Then, the sheets S stacked on the middle plate 25 are pressed against the feed roller 3 with a predetermined sheet feeding pressure. It is noted that the middle plate 25 is formed into a shape enabling the side end restricting members 22 and 23 and the rear end restricting member 24 to move to positions restricting sheets from a maximum size to a minimum size.

The pair of side end restricting members 22 and 23 includes rack portions 221 and 231 extending in same directions (directions of an arrow B in FIG. 2) with the width direction, i.e., moving directions of the side end restricting members 22 and 23, respectively below thereof. Rack teeth not shown and formed on the rack portions 221 and 231 mesh with a pinion 261 provided below the bottom surface of the cassette body 21. Thereby, if either one of the side end restricting members 22 and 23 is moved in the width direction, another one of the side end restricting members 22 and 23 is interlocked and moves in an opposite direction from one of the side end restricting members 22 and 23 by an action of the pinion 261 and the rack portions 221 and 231. It is noted that the side end restricting members 22 and 23 are configured to be positioned by engaging locking lock members not shown and provided in the side end restricting members 22 and 23 with grooves not shown and provided in the cassette body 21.

Figure 4:
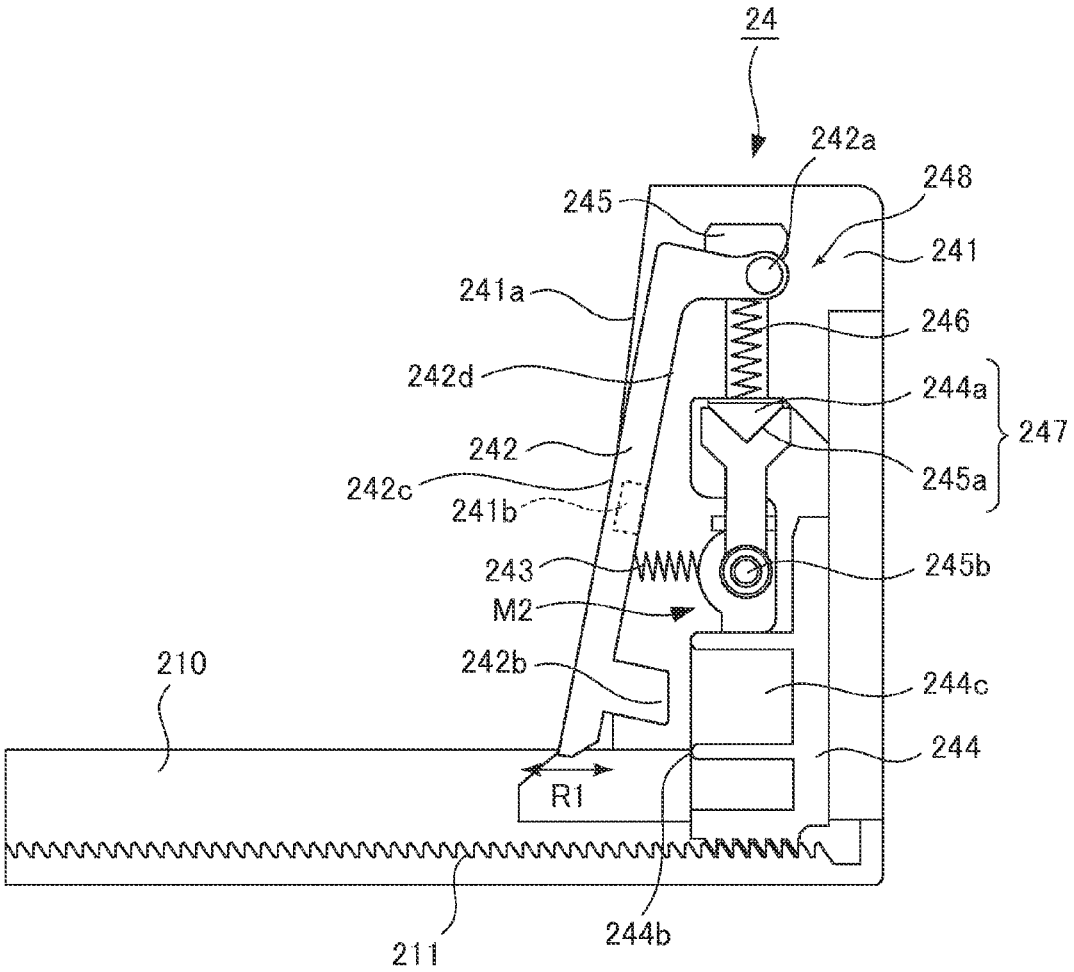
FIG. 4 illustrates a configuration of a rear end restricting member provided in the sheet feeding cassette.

The rear end restricting member 24 is also movable in the sheet feeding direction along a guide groove 210 provided in a direction of an arrow C on a bottom plate of the cassette body 21. It is noted that the guide groove 210 is provided with rack teeth 211 formed along the sheet feeding direction as shown in FIG. 4 described later. A plurality of engage grooves 21*a*, i.e., engaged portions, corresponding to positions of rear ends of regular size sheets is provided on the bottom plate of the cassette body 21. Then, the rear end restricting member 24 is configured to be positioned by locking a lock portion 24*a* such as a pin provided in the rear end restricting member 24 to one of the plurality of engage grooves 21*a*.

It is noted that the lock portion 24*a* is configured to be movable up and down by a lever member 245 described later and to be able to lock the rear end restricting member 24 at the position corresponding the rear end of the regular size sheet by engaging with either one of the plurality of engage grooves 21*a*. These plurality of engage grooves 21*a* and the lock portion 24*a* compose a regular size lock mechanism M1 locking the rear end restricting member 24 at the position corresponding to the rear end of the regular size sheet.

In storing the sheets S of various sizes in the cassette body 21, the side end restricting members 22 and 23 and the rear end restricting member 24 are positioned at a position preset per each size of the sheet to be stored. This arrangement makes it possible to store the sheets S at the adequate position. It is noted that the sheet feeding cassette 2 is attached to the apparatus body 1A in a direction of an arrow A (see FIG. 2) in feeding the sheet S. After that, the middle plate 25 is turned upward by the elastic member 26 such that an upper surface of the sheet S comes into pressure contact with the feed roller 3. Thereby, the sheet S positioned by the side end restricting members 22 and 23 and the rear end restricting member 24 is pressed against the feed roller 3 and is then delivered as the feed roller 3 rotates.

It is noted that as a method for storing the sheet S in the cassette body 21, there is a method of settling the sheet S by moving the side end restricting members 22 and 23 and the rear end restricting member 24 to a position corresponding to an end of the sheet S after placing the sheet S on the middle plate 25. There is also a method of placing the sheet S on the middle plate 25 after moving and positioning the side end restricting members 22 and 23 and the rear end restricting member 24 in advance to the position corresponding to the end of the sheet.

Figure 3:
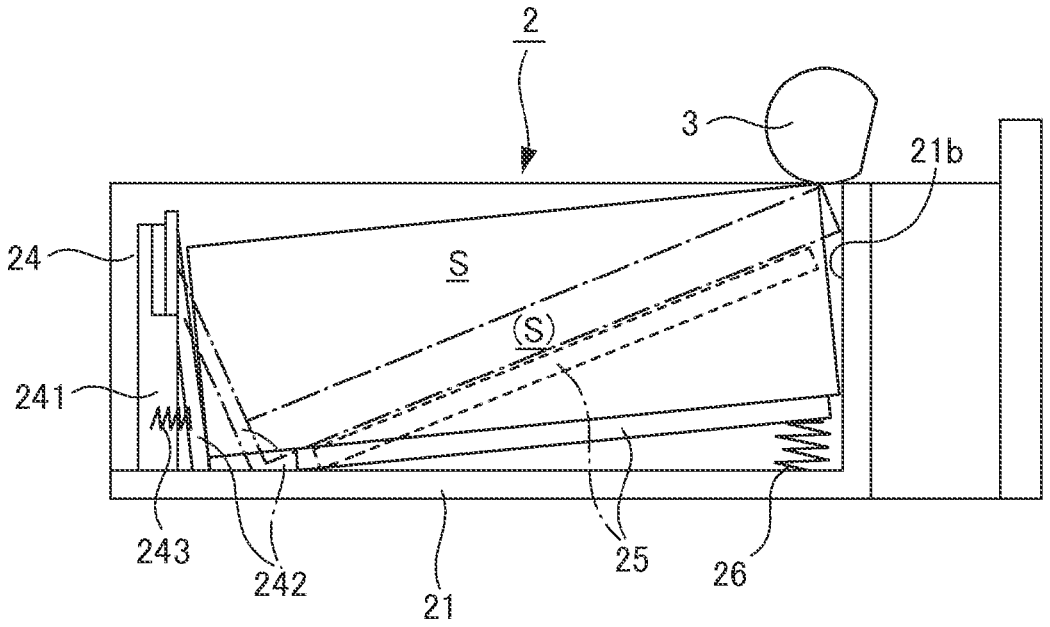
FIG. 3 is a second diagram illustrating the configuration of the sheet feeding cassette.

As shown in FIG. 3, the rear end restricting member 24 includes a rear end restricting portion 241 which is a holding portion (body portion) restricting the rear end of the stored sheet and a press member (abutment portion) 242 storable within the rear end restricting portion 241. Here, the rear end restricting portion 241 is provided in the sheet feeding cassette 2 such that the rear end restricting portion 241 is movably with respect to the cassette body 21 in the sheet feeding direction (more specifically in the first and second directions) and includes a counterface surface 241*a* facing to the rear end (downstream end in the sheet feeding direction) of the sheet as shown in FIG. 4 and as described later. As shown in FIG. 4 described later, the press member 242 is supported by the rear end restricting portion 241 such that a lower part thereof is swingable with respect to the rear end restricting portion 241 through an intermediary of a swing shaft 242*a* located at an upper part of the press member 242. That is, the press member 242 is attached to the rear end restricting portion 241 such that the press member 242 is movably with respect to the rear end restricting portion 241 in the first and second directions and includes an abutting surface 242*c* abutting against the end of the sheet. Furthermore, the press member 242 is biased by a bias member 243, i.e., a bias portion, such as a spring toward the sheet feeding direction (first direction) or more specifically such that the press member 242 projects to a sheet side from the counterface surface 241*a* of the rear end restricting portion 241.

It is noted that the rear end restricting portion 241 is configured to be able to store the press member 242. Then, the press member 242 is set back and is stored in the rear end restricting portion 241 until the abutting surface 242*c* is substantially in flush with the counterface surface 241*a* of the rear end restricting portion 241 by resisting against a bias force of the bias member 243 when the press member 242 is pressed from a forward direction by the sheets by a force greater than the bias force of the bias member 243. This position will be referred to as a setback position of the press member 242. The press member 242 biased by the bias member 243 is configured such that a lower end of the press member 242 is held at a projecting position projecting out of the rear end restricting portion 241 by a predetermined degree by a stopper 241*b* provided in the rear end restricting portion 241.

The press member 242 prevents the sheet S from slipping rearward when the middle plate 25 is turned upward by pressing the rear end of the sheet S placed on the middle plate 25. As indicated by a solid line in FIG. 3, when the sheets S are fully loaded on the middle plate 25, the sheet S will not slip rearward because an angle formed between the middle plate 25 and a horizontal plane is small. At this time, although the press member 242 presses the rear end of the sheets S in a case where the rear end restricting portion 241 is locked by the regular size lock mechanism M1, the press member 242 will not push the sheet bundle strongly forward because a large number of sheets S is stacked and its total weight is large. Due to that, a front end of the sheets S will not be pressed against the front wall 21*b* of the cassette body 21 with a large force.

When the sheets S are fed and the sheets stacked on the middle plate 25 decrease, the middle plate 25 rises and the angle of the middle plate 25 from the horizontal plane become large as indicated by a broken line in FIG. 3. Thereby, a distance along the upper surface of the sheet bundle from the rear end restricting member 24 to the feed roller 3 increases. Due to that, even though the bundle of the sheets S is apt to slip rearward, the press member 242 projects forward by the bias force of the bias member 243 and presses the sheets S to the feed roller 3 side because the number of stacked sheets S decreases at this time as indicated by a dot chain line and the total weight of the sheets S decreases. This configuration makes it possible to prevent the sheets S from slipping rearward. It is also possible to reliably bring the sheet S into pressure contact with the feed roller 3 even if a small amount of sheets S is loaded by preventing the sheets S from slipping rearward by the press member 242. Thus, this configuration permits to prevent the sheet feeding failure.

Rack teeth 211 extending in the sheet feeding direction as shown in FIG. 4 are provided on the guide groove 210 provided in the cassette body 21. Then, the rear end restricting member 24 is provided with a rack member 244, i.e., an engaging portion, locking the rear end restricting member 24 to the cassette body 21 by engaging with the rack teeth 211 of the cassette body 21, i.e., an engaged portion, movably in the vertical direction. That is, the rack member 244 is attached to the rear end restricting portion (holding portion) 241 such that the rack member 244 position upstream (rearward in the first direction), in the sheet feeding direction, of the press member 242 to face the press member 242 and is configured to move in the vertical direction between an engage position where the rack member 244 engages with the rack teeth 211 provided on the sheet feeding cassette 2 and a disengage position where the rack member 244 is disengaged from the rack teeth 211. Then, the rack member 244 constitutes a first restricting portion restricting the move of the rear end restricting portion (holding portion) 241 and determining a position in the sheet feeding direction (the first direction) of the press member 242. It is noted that the rack member 244 meshable (engageable) with the rack teeth 211 of the cassette body 21 is biased in a direction toward the rack teeth 211 by a bias member 246 whose one end is locked to a lock portion not shown provided in the rear end restricting portion 241.

Figure 5A:
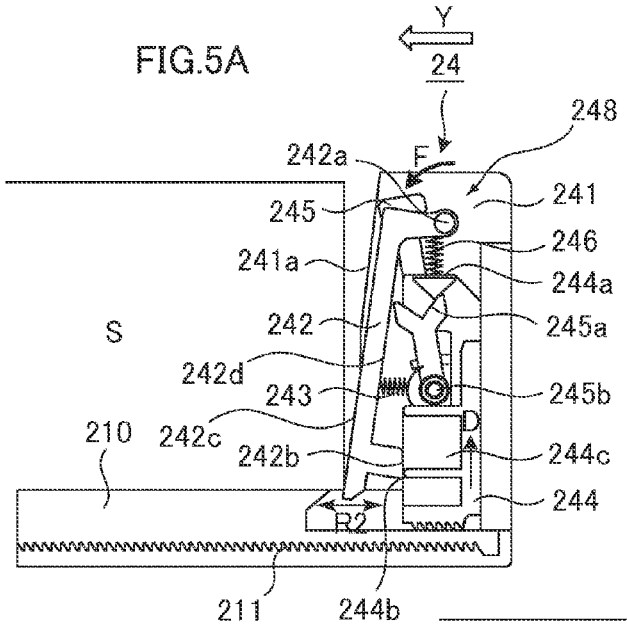
FIG. 5A is a diagram illustrating the rear end restricting member in a state in which a lever member is inclined in a direction of an arrow F.
Figure 5B:
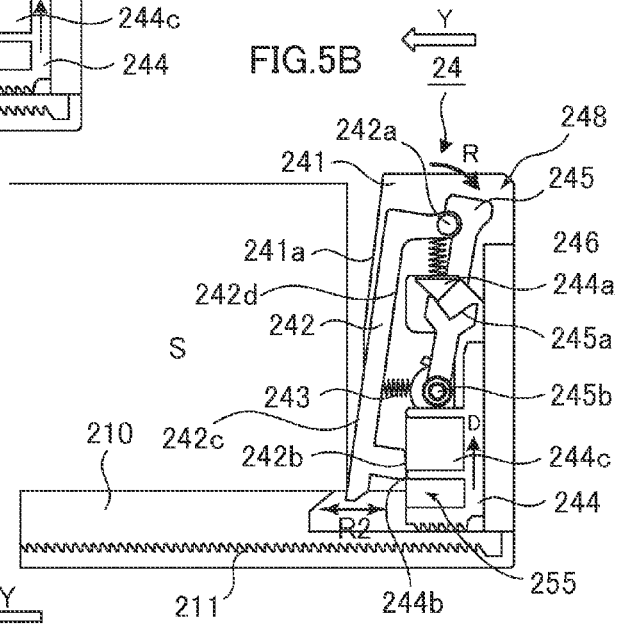
FIG. 5B is a diagram illustrating the rear end restricting member in a state in which the lever member is inclined in a direction of an arrow R.
Figure 5C:
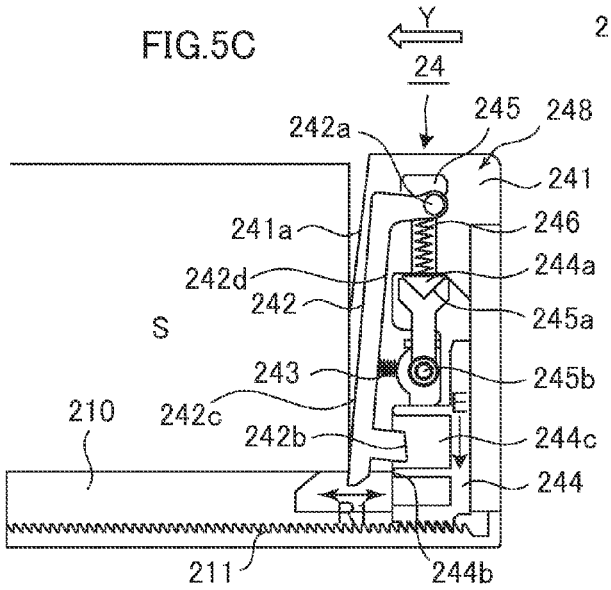
FIG. 5C is a diagram illustrating the rear end restricting member in a state in which the lever member is located at a neural position.

The rear end restricting portion 241 is also provided with a lever member 245 configured to unlock the rack member 244 and to enable the rear end restricting member 24 to move swingably along the sheet feeding direction through an intermediary of a swing shaft 245*b* as shown in FIGS. 5A through 5C. That is, the lever member 245 is attached to the rear end restricting portion (body portion) 241 so as to face to the press member 242 upstream (rearward in the first direction) in the sheet feeding direction of the press member 242 and is configured to be turnable with respect to the rear end restricting portion (body portion) 241 and thereby to be operable to be pressed to the upstream and downstream sides in the sheet feeding direction, i.e. in the first and second directions. The lever member 245 is provided with a cam portion 245*a* whose upper part is opened coaxially with the swing shaft 245*b*, and the rack member 244 is provided with a cam follower portion 244*a* that engages with the cam portion 245*a* from above by being biased by the bias member 246 such as a spring.

It is noted that in the present embodiment, the cam portion 245*a* and the cam follower portion 244*a* are formed to be symmetrical, and an unlock direction, i.e., an operative direction, of the lever member 245 is upstream and downstream directions of the sheet feeding direction. Then, the rack member 244 is lifted by the cam portion 245*a* through an intermediary of the cam follower portion 244*a* by pressing and inclining the lever member 245 to the upstream side or to the downstream side in the sheet feeding direction. Thus, the rack member 244 is moved to the unlock position where the rack member 244 is disengaged from the rack teeth 211. An irregular size lock mechanism M2 locking the rear end restricting member 24 at a position corresponding to the rear end of an irregular size sheet is composed of the rack member 244, the lever member 245, the cam portion 245*a*, the cam follower portion 244*a*, and others.

This arrangement makes it possible to unlock and to move the rear end restricting member 24 and corresponding to each sheet size. That is, the releasing portion 248 configured to release the restriction on the move of the rear end restricting portion 241 made by the rack member 244 is composed of the lever member 245, the cam portion 245*a*, and the cam follower 244*a*. Still further, the cam portion 245*a* and the cam follower 244*a* compose an interlocking portion 247 that moves the rack member 244 upward such that the rack member 244 is located from the engage position where the rack member 244 engages with the rack teeth (engaged portion) 211 to the disengage position where the engagement with the rack teeth 211 is released by converting a direction of an action of a turning force of the lever member 245 upward and transmitting the turning force to the rack member (engaging portion) 244. It is noted that the interlocking portion 247 can be said to be a part provided between the lever member 245 and the rack member 244 and lifting the rack member 244 to the disengage position where the rack member 244 is disengaged from the sheet stacking member following an operation of the lever member 245.

By the way, in the present embodiment, a stopper portion 242*b* is provided so as to project on a side of the rack member 244 of a lower end part of the press member 242 as shown in FIG. 4. Still further, the rack member 244 is provided with an interference portion 244*b*, i.e., a second restricting portion, abutting against the stopper portion 242*b* of the press member 242 and an opening portion 244*c* provided above the interference portion 244*b* and opened to the press member 242 side. More specifically, the stopper portion 242*b* is composed of a first projection projecting to the upstream side in the sheet feeding direction (in the second direction) on a back surface 242*d* opposite from an abutting surface 242*c* of the press member 242. The interference portion 244*b* is composed of a second projection projecting toward the downstream side in the sheet feeding direction (in the first direction) at a position facing to the stopper portion 242*b* when the rack member 244 is located at the disengage position. Still further, the opening portion 244*c* is formed of a space concaved to the upstream side in the sheet feeding direction (concaved to in the second direction) with respect to the interference portion 244*b* at the position facing to the stopper portion 242*b* when the rack member 244 is located at the engage position. It is noted that a position of the rack member 244 when the vertically movable rack member 244 is lifted and the interference portion 244*b* faces to the stopper portion 242*b* of the press member 242 will be referred to as a restricting position.

Next, an operation for restricting a sheet rear end position conducted by the rear end restricting member 24 constructed as described above will be explained. It is noted that although the present embodiment is configured to unlock the rear end restricting member 24 by pressing and inclining the lever member 245 in a direction in which the rear end restricting member 24 is to be moved, it is possible to unlock the rear end restricting member 24 by pinching and inclining the lever member 245. In moving the rear end restricting member 24 in a direction of an arrow Y shown in FIGS. 5A through 5C to restrict the sheet rear end position for example, the lever member 245 is inclined at first in a direction of an arrow F shown in FIG. 5A or in a direction of an arrow R shown in FIG. 5B.

Here, if the lever member 245 is inclined in the direction of the arrow F shown in FIG. 5A, the cam portion 245*a* swings counterclockwise and the cam follower portion 244*a* of the rack member 244 is lifted by the swing of the cam portion 245*a* while resisting against the bias member 246. Along with that, the rack member 244 moves in a direction of an arrow D and separates from the rack teeth 211 within the cassette body 21. Thus, the rear end restricting member 24 is unlocked and becomes movable.

If the lever member 245 is inclined in the direction of the arrow R shown in FIG. 5B, the cam portion 245*a* swings clockwise and the cam follower portion 244*a* of the rack member 244 is lifted by the swing of the cam portion 245*a* while resisting against the bias member 246. Along with that, the rack member 244 moves in the direction of the arrow D and is separated from the rack teeth 211 within the cassette body 21. Thus, the rear end restricting member 24 becomes movable. Here, if the rack member 244 moves in the direction of the arrow D, the interference portion 244*b* is positioned to the restricting position where the interference portion 244*b* faces to the stopper portion 242*b* provided on the press member 242 as shown in FIGS. 5A and 5B. It is noted that at this time, the press member 242 projects to the sheet side from a counterface surface 241*a* in contact with the rear end of the sheet of the bias member 243 by a predetermined amount by a bias force of the bias member 243 as shown in FIG. 4.

Next, if the rear end restricting member 24 is moved toward the rear end of the sheets stacked on the middle plate 25 while keeping the state in which the rear end restricting member 24 is unlocked by inclining the lever member 245 in the direction of the arrow F or R, the press member 242 projecting by the predetermined amount abuts against the sheet rear end. Here, if the rear end restricting member 24 is moved further, while the press member 242 swings to the rear end restricting portion side by resisting against the bias force of the bias member 243, the swing of the press member 242 at this time is restricted at the move restricting position because the stopper portion 242*b* abuts against the interference portion 244*b*. It is noted that a move restricting portion 255 capable of restricting the press member 242 in the move restricting position between the projecting position and the setback position is composed of the stopper portion 242*b* and the interference portion 244*b* integrally formed with the rack member 244. That is, the press member 242 is movable to the upstream side (in the second direction) in the sheet feeding direction until when the abutting surface 242*c* restricts the end of the sheet together with the counterface surface 241*a* of the rear end restricting portion 241 in a first movable range set when the move of the rear end restricting member 24 is restricted. Still further, in a second movable range set when the restriction on the move of the rear end restricting member 24 is released, the move of the press member 242 to the upstream side in the sheet feeding direction is restricted by the cam follower 244*a* at a position where at least apart of the abutting surface 242*c* projects to the downstream side in the sheet feeding direction (in the first direction) more than the counterface surface 241*a*.

If the rear end restricting member 24 is moved as described above and the press member 242 abuts against the sheet rear end, the press member 242 moves between the projecting position and the move restricting position where the stopper portion 242*b* abuts against the interference portion 244*b* corresponding to a moving distance of the rear end restricting member 24. It is noted that the moving distance of the press member 242 between the projecting position and the move restricting position is set such that it is equal to a difference between a front end position of sheets fully loaded in a state in which the press member 242 is omitted and a front end position of sheets slipped and moved to the rear end restricting member side with the upward turn of the middle plate 25 when a small amount of sheets is loaded.

Here, because the stopper portion 242*b* abuts against the interference portion 244*b* and the move of the press member 242 is restricted at the move restricting position in moving the rear end restricting member 24, it is possible to keep the state in which the press member 242 projects out of the rear end restricting portion 241. In other words, it is possible to prevent the press member 242 from being pressed into the setback position in moving the rear end restricting member 24.

That is, even if the press member 242 is pressed toward the sheets in the unlocked state by operating the lever member 245 in setting the rear end restricting member 24, the restriction of the press member 242 at the move restricting position is released if the rear end restricting member 24 is locked by leaving the lever member 245. In this state, because the press member 242 is biased by the bias force of the bias member 243, the sheets are not pressed unnecessarily by the press member 242 and the sheets do not push out with a large force between the front wall of the cassette body 21 and the rear end restricting member 24.

In other words, it can be said that the interference portion 244*b* constitutes the second restricting portion restricting the movable range of the press member (abutment portion) 242 to the upstream side (in the second direction) in the sheet feeding direction downstream (forward in the first direction) in the sheet feeding direction more than the case where the move of the rear end restricting portion 241 is restricted by the rack member (first restricting portion) 244 in response to the operation for releasing the restriction on the move of the rear end restricting portion (holding portion) 241 made through the releasing portion 248.

That is, the interference portion 244*b* can be the second restricting portion restricting the movable range of the press member 242 from the first movable range (the movable range R1 in FIGS. 4 and 5C) set when the move of the rear end restricting portion 241 is restricted to the second movable range (the movable range R2 in FIGS. 5A and 5B) set when the restriction on the move of the rear end restricting portion 241 is released corresponding to the operation of releasing the restriction on the move of the rack member 244 made through the releasing portion 248. Then, in the present embodiment, this second movable range is set such that the end position on the upstream side in the sheet feeding direction (the second direction) comes to the downstream side in the sheet feeding direction (forward the first direction) more than the first movable range, i.e., a movable range in the second direction of the second movable range is narrower than a movable range in the second direction of the first movable range. The second movable range is also set such that at least part of the abutting surface 242*c* of the press member 242 is located downstream in the sheet feeding direction of the abutting surface 242*c* of the rear end restricting portion 241 at the end position upstream in the sheet feeding direction.

This series of operations will be explained in detail further. When the operation described above is finished by releasing the lever member 245 after moving the rear end restricting member 24, the rack member 244 which has been lifted by resisting against the bias member 246 moves in a direction of an arrow E as shown in FIG. 5C and engages with and locked by the rack teeth 211 of the cassette body 21. The lever member 245 also returns to its original state by being restricted by the cam portion 245*a* and the cam follower portion 244*a* by the bias member 246. That is, if the lever member 245 is released in the state in which the lever member 245 is inclined, the lever member 245 returns to the original vertical state by the bias force of the bias member 246 and the rear end restricting member 24 is locked concurrently.

If the rack member 244 moves here in the direction of the arrow E here, the interference portion 244*b* drops to the position where the opening portion 244*c* faces to the stopper portion 242*b* of the press member 242. Thereby, the restriction of swing of the press member 242 in the setback direction to the rear end restricting portion 241 is released. It is noted that although the restriction of the swing of the press member 242 is eliminated in the state in which the rear end restricting member 24 is positioned as described above, the function of preventing the slip of the sheet S performed by the press member 242 is not lost because the press member 242 is biased by the bias member 243.

Next, an operation for restricting the rear end of the sheets S stored in the sheet feeding cassette 2 will be explained. The lever member 245 is inclined in the direction of the arrow F as shown in FIG. 5A or 5B from a state in which the rear end restricting member 24 is separated from the sheet rear end in order to abut the rear end restricting member 24 against the rear end of the sheets S of the regular size stacked on the middle plate 25. By operating the lever member 245 as described above, the rack member 244 is lifted to the disengage position and is disengaged from the rack teeth 211, i.e., the engaged portion. Then, because the rear end restricting member 24 is unlocked, the rear end restricting member 24 can be moved toward the end of the sheets. Still further, the interference portion 244*b* of the rack member 244 restricting the swing of the press member 242 moves to the restricting position restricting the swing of the press member 242, i.e., the position indicated in FIG. 5A or 5B, if the rack member 244 is lifted by inclining the lever member 245.

The rear end restricting member 24 is moved in this state and is locked at the position restricting the rear end of the regular size sheet by the regular size lock mechanism M1. The rear end restricting member 24 is locked because the lock portion 24*a* engages with the engage groove 21*a* by releasing and returning the lever member 245 to the state in which the lock portion 24*a* corresponds to the engage groove 21*a* provided on the bottom surface of the cassette body 21.

Still further, if the lever member 245 is released to lock the rear end restricting member 24, the interference portion 244*b* drops to the restriction releasing position where the opening portion 244*c* faces to the stopper portion 242*b* of the press member 242. Thereby, the restriction of the swing of the press member 242 by the interference portion 244*b* is released. Thereby, the press member 242 enters the opening portion 244*c* of the rack member 244 even if size of the sheets is largest in terms of tolerance of the sheets and can press the sheets by the bias force of the bias member 243. It is noted that the less the sheets stacked on the middle plate 25 decreases from a fully loaded condition, the more the project amount of the press member 242 increases. This configuration makes it possible to reliably prevent the sheets from slipping rearward from the feed roller 3 even if the number of sheets stacked on the middle plate 25 is small.

Here, there is a case of pressing the rear end restricting member 24 further toward the sheets S without locking by the regular size lock mechanism M1 by keeping the lever member 245 in the inclined condition in positioning the rear end of the regular size sheets S by moving the rear end restricting member 24. If the rear end restricting member 24 is pressed as described above and the lever member 245 is released at such a position, the rear end restricting member 24 is locked by the irregular size lock mechanism M2.

If the rear end restricting member 24 is pressed to and fixed at the sheet side, the counterface surface 241*a* of the rear end restricting portion 241 presses the rear end of the sheets in a state in which the press member 242 is stored in the rear end restricting portion 241 in the conventional configuration. Then, if the rear end is pressed, the sheets S is held by a strong force between the front wall of the cassette body 21 and the rear end restricting member 24, so that there is a possibility of causing sheet feeding failure and the like.

In contrary to that, in the configuration of the present embodiment, the press member 242 is restricted in the move restricting position where the press member 242 projects out of the counterface surface 241*a* of the rear end restricting portion 241 in moving the rear end restricting member 24 in the condition in which the lever member 245 is inclined. Due to that, the sheets S are held by a strong force between the front wall of the cassette body 21 and the press member 242 restricted in the move restricting position by the rear end restricting portion 241.

After that, if the lever member 245 is returned in the condition in which the rear end restricting member 24 is pressed to the sheet side and the rear end restricting member 24 is fixed by the irregular size lock mechanism M2, the restriction of the press member 242 is also released. If the restriction of the press member 242 is released as described above, the press member 242 is put into the condition in which the press member 242 is biased just by the bias member 243, so that it is possible to avoid the sheets S from being held by a large force between the front wall of the cassette body 21 and the press member 242. That is, the sheets S are pressed by the press member 242 just biased by the bias member 243, so that it is possible to prevent the conventional sheet feeding failure and the like.

As described above, According to the present embodiment, the interference portion 244*b* is moved to the restricting position facing to the stopper portion 242*b* of the press member 242 in linkage with the operation of the lever member 245 in moving the rear end restricting member 24 to restrict the move of the press member 242 to the setback position. Then, it is possible to move the rear end restricting member 24 while keeping the state in which the press member 242 projects out of the rear end restricting portion 241 by restricting the press member 242 in the move restricting position between the projecting position and the setback position.

Thereby, even in the case where the rear end restricting member 24 is pressed against the rear end of the sheets, it is possible to prevent the press member 242 from being pushed into the setback position and the sheets are not pressed by the press member 242 unnecessarily when the rear end restricting member 24 is locked. As a result, the sheets are not pressed to the front wall of the cassette body 21 when the rear end restricting member 24 is locked. This configuration makes it possible to prevent the sheet feeding failure caused by disablement of lift-up of the middle plate 25 due to a friction between the front end of the sheets and the front wall of the cassette body 21 or by a loss of a sheet feeding pressure.

That is, it is possible to set the rear end restricting member 24 without causing the sheet feeding failure by keeping the state in which the press member 242 projects out of the rear end restricting portion 241 in moving the rear end restricting member 24 as described in the present embodiment. Still further, it is possible to prevent the sheets from being pressed unnecessarily by the press member 242 without using another member by providing the interference portion 244*b* in the rack member 244 as described in the present embodiment, it is possible to feed the sheets costly and stably.

Figure 6:
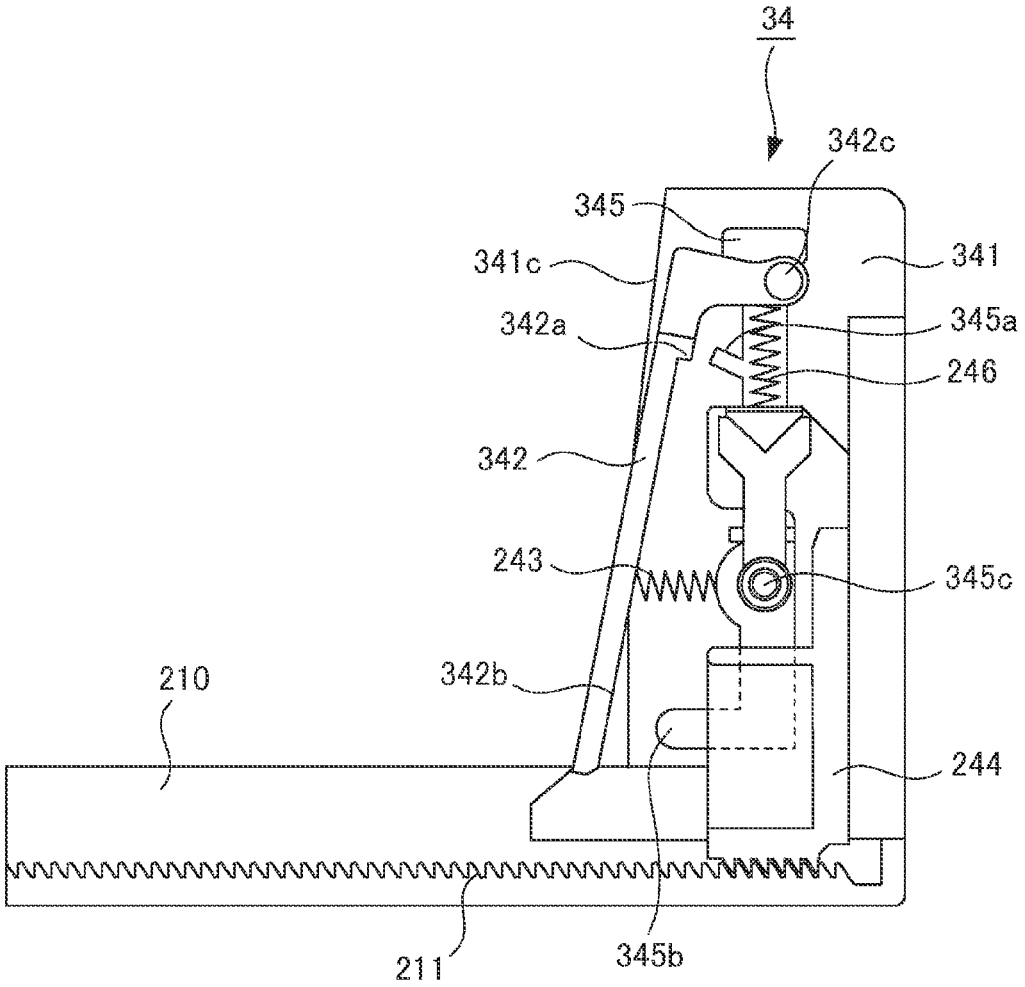
FIG. 6 illustrates a configuration of a rear end restricting member provided in a sheet feeding cassette of a sheet feeding apparatus of a second embodiment of the invention.

A second embodiment of the present invention will be explained below. FIG. 6 illustrates a configuration of a rear end restricting member 34 provided in the sheet feeding cassette of a sheet feeding apparatus of the second embodiment. It is noted that in FIG. 6, reference numerals identical with those described already in FIG. 4 denote the same or corresponding parts. The regular size and irregular size lock mechanisms are also the same with those in the first embodiments, so that their drawings and detailed description will be omitted here.

As shown in FIG. 6, the rear end restricting member 34 includes a rear end restricting portion 341, i.e., a body portion, restricting a rear end of sheets stored in the cassette and having a sheet abutting surface 341*c* abutting against the rear end of the sheets. The rear end restricting member 34 further includes a press member 342 supported by the rear end restricting portion 341 swingably at a fulcrum of a swing shaft 342*c* and a lever member 345 provided in the rear end restricting portion 341 swingably along the sheet feeding direction through the intermediary of a swing shaft 345*c*.

The lever member 345 is provided with a first stopper portion 345*a*, i.e., an upper restricting portion, at an upper end part of the lever member 345 and with a second stopper portion 345*b*, i.e., a lower restricting portion, at a lower end part of the lever member 345. The press member 342 is also provided with a first abutting portion 342*a* abutting against the first stopper portion 345*a* of the lever member 345 at an upper part of the press member 342 and with a second abutting portion 342*b* abutting against the second stopper portion 345*b* at a lower part of the press member 342. That is, a move restricting portion is composed of the first and stopper portions 345*a* and 345*b* of the lever member 345 and the first and second abutting portions 342*a* and 342*b* of the press member 342 in the present embodiment.

Figure 7A:
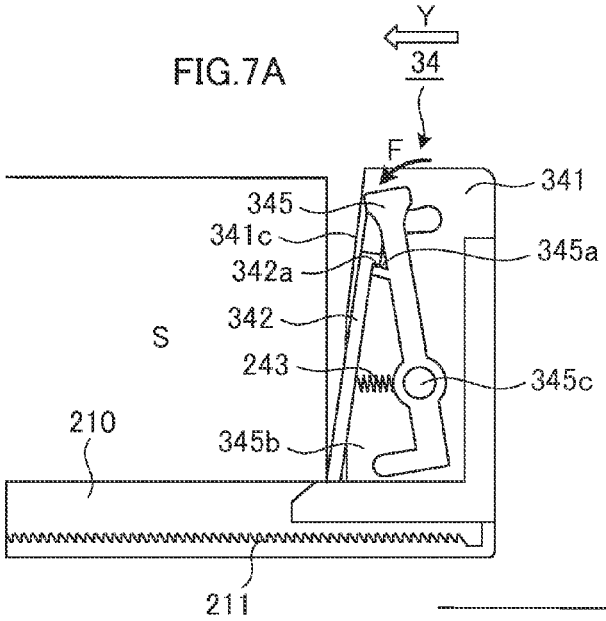
FIG. 7A is a diagram illustrating a rear end restricting member of the second embodiment in a state in which the lever member is inclined in the direction of the arrow F.

Then, the lever member 245 is inclined in a direction of an arrow F as shown in FIG. 7A to move the rear end restricting member 34 in a direction of an arrow Y. When the lever member 345 is inclined in the direction of the arrow F as described above, the press member 342 can move to a move restricting position where the first stopper portion 345*a* of the lever member 345 abuts against the first abutting portion 342*a* of the press member 342. After that, if the rear end restricting member 34 is moved toward the rear end of the sheets while keeping the condition in which the lever member 345 is inclined, the press member 342 abuts against the rear end of the sheets. If a moving amount of the rear end restricting member 34 is large here, the press member 342 swings to the rack member side by resisting against the bias force of the bias member 243. An amount of the swing of the press member 342 at this time, i.e., a swing amount of the press member 342 in the setback direction, is restricted by the abutment of the first abutting portion 342*a* of the press member 342 against the first stopper portion 345*a*.

Figure 7B:
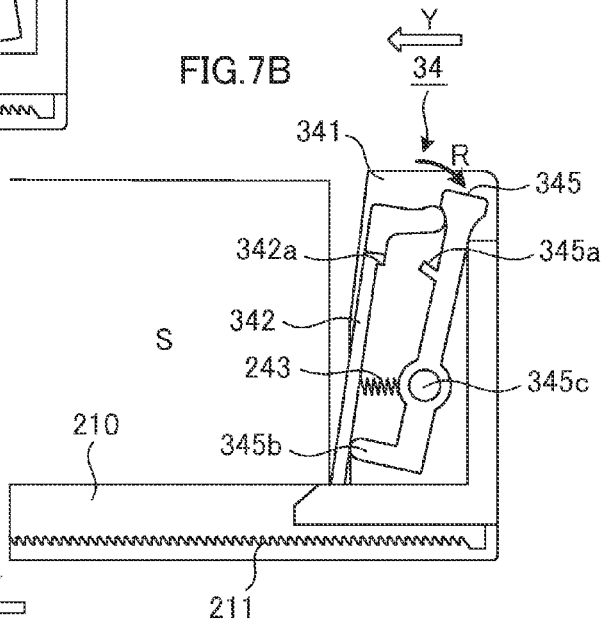
FIG. 7B is a diagram illustrating the rear end restricting member of the second embodiment in a state in which the lever member is inclined in the direction of the arrow R.

If the lever member 345 is inclined in a direction of an arrow R as shown in FIG. 7B, the press member 342 can move to a move restricting position where the second abutting portion 342*b* of the press member 342 abuts against the second stopper portion 345*b*. After that, if the rear end restricting member 34 is moved toward the rear end of the sheet while keeping the condition in which the lever member 345 is inclined, the press member 342 abuts against the rear end of the sheets. If a moving amount of the rear end restricting member 34 is large here, the press member 342 swings to the rack member side and the second abutting portion 342*b* of the press member 342 abuts against the second stopper portion

345*b*. Thereby, the swing amount in the setback direction of the press member 342 is restricted.

If the press member 342 abuts against the rear end of the sheets along with the move of the rear end restricting member 34, the press member 342 moves corresponding to a moving amount of the rear end restricting member 34 between the projecting position and the restricting position where the first abutting portion 342*a* abuts against the first stopper portion 345*a*. Or, depending on the direction in which the lever member 345 is inclined, the press member 342 moves between the projecting position and the position where the second abutting portion 342*b* abuts against the second stopper portion 345*b*. A moving range of the press member 342 is set to be equal to a difference between a front end position of sheets when fully loaded and a front end position of the sheets moved to the rear end restricting member 24 side along with the upward turn of the middle plate 25 when an amount of loaded sheets is small.

Figure 7C:
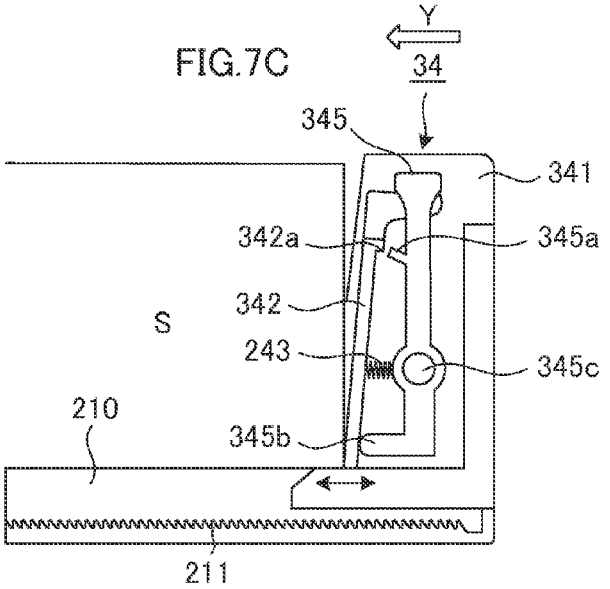
FIG. 7C is a diagram illustrating the rear end restricting member of the second embodiment in a state in which the lever member is located at a neural position.

When the lever member 345 is released after moving the rear end restricting member 34, the rack member 244 which has been lifted up by resisting against the bias member 246 as described above drops and engages with and is locked by the rack teeth 211. The lever member 345 also returns to its original state as shown in FIG. 7C.

When the lever member 345 returns to its original state as described above, the first and second stopper portions 345*a* and 345*b* set back from the restricting position where the first and second stopper portions 345*a* and 345*b* can abut against the abutting portion 342*a* and 342*b* of the press member 342 and the restriction of the swing of the press member 342 is released. Thereby, the press member 342 can be set back by a reaction force of the held sheets even if the size of the sheets is in maximum in terms of tolerance, so that the sheets whose sheet size is in maximum in terms of tolerance can be also stored.

The rear end restricting member 34 is moved toward the rear end of the sheets to restrict the regular size sheets by the rear end restricting member 34. At this time, there is a case where the rear end restricting member 34 is pushed into the sheets without locking the rear end restricting member 34 by the regular size lock mechanism M1 and the rear end restricting member 34 is locked by the irregular size lock mechanism M2. Similarly to the contents explained in the first embodiment, the press member 342 abuts against the rear end of the sheets in the condition in which the press member 342 projects out of the rear end restricting portion 341 and is locked in the move restricting position and the lock of the press member 342 is released when locked by the irregular size lock mechanism M2 also in this case. Due to that, because the rear end of the sheets is pressed only by the bias force of the press member 342, the sheets S are not held with a large force between the front wall of the cassette body and the rear end restricting member 34. Thus, it is possible to prevent an occurrence of sheet feeding failure.

As described above, according to the present embodiment, one of the first and second stopper portions 345*a* and 345*b* is moved to the restricting position in conjunction with the operation of the lever member 345 in moving the rear end restricting member 34. The move of the press member 342 to the move restricting position between the projecting position and the setback position is restricted by the first and second stopper portions 345*a* and 345*b*. That is, in the present embodiment, the interference portion restricting the movable range of the press member 342 to the second movable range described above is configured by the first and second stopper portions 345*a* and 345*b* integrally formed with the lever member 345 such that the first and second stopper portions 345*a* and 345*b* take interference positions (positions shown in FIG. 7A or 7B) interfering with the press member 342 when the lever member 345 is turned. More specifically, these first and second stopper portions 345*a* and 345*b* are disposed separately in the vertical direction with the center of turn 345*c* of the lever member 345 between them. The first stopper portion 345*c* is configured to be a first lever projection formed projectively to the downstream side in the sheet feeding direction (in the first direction) above the center of turn 345*c*. The second stopper portion 345*b* is configured to be a second lever projection formed projectively to the downstream side in the sheet feeding direction below the center of turn 345*c*. Then, the rear end restricting member 34 can be moved while keeping the state in which the press member 342 projects out of the rear end restricting portion 341 by restricting the move of the press member 342 to the move restricting position between the projecting position and the setback position by the first or second stopper portion 345*a* or 345*b*.

Thereby, it is possible to prevent the press member 342 from being pressed into the setback position even if the rear end restricting member 34 is pressed against the rear end of the sheets and the sheets are not pressed by the press member 342 unnecessarily when the rear end restricting member 34 is set. As a result, the rear end restricting member 34 can be set without causing sheet feeding failure. Thus, the second embodiment brings about the same advantageous effects with those of the first embodiment.

It is noted that although the press member 342 is configured to be stored in the rear end restricting portion (body portion) 241 such that the press member 342 does not project out of the counterface surface 241*a* at the setback position in the present embodiment, it is not always necessary to construct the press member 342 as described above. That is, the press member 342 may project out of the counterface surface 241*a* at the setback position as long as the position of the end of the movable range upstream in the sheet feeding direction of the movable range of the press member 342 in the second movable range is located downstream in the sheet feeding direction of the first movable range and downstream in the sheet feeding direction of the counterface surface 241*a* facing to the downstream end in the sheet feeding direction of the sheet of the rear end restricting portion (body portion) 241. Still further, although the sheet feeding direction is matched with the direction in which the press member moves in the embodiment described above, the lever member is not limited to such configuration as long as a horizontal component direction of a direction in which the sheet stacked along the inclination of the middle plate 25 slides when the middle plate 25 is turned upward is the second direction and a direction opposite from the second direction is the first direction. Furthermore, although the sheet stacking apparatus is composed by the sheet cassette as a sheet storing apparatus, the present invention may apply to a feeding unit of ADF (auto document feeder), a manual feed portion or the like. In this case, the sheet stacking portion which is composed by a sheet storing portion storing the sheet may be a sheet stacking tray, a manual feed tray or the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-006947 filed on Jan. 17, 2014 which is hereby incorporated by reference herein in its entirety.

What is claimed is:

1. A sheet stacking apparatus comprising:

a sheet stacking member on which a sheet is stacked; and a sheet restricting portion configured to restrict a position of an end of the sheet stacked on the sheet stacking member, the sheet restricting portion including:

a holding portion provided in the sheet stacking member, the holding portion being movably with respect to the sheet stacking member in a first direction and a second direction opposite to the first direction;

a first restricting portion configured to determine a position of the holding portion in the first direction by restricting a move of the holding portion;

a releasing portion configured to release the restriction of the holding portion made by the first restricting portion;

an abutment portion attached to the holding portion, the abutment portion being movably with respect to the holding portion in the first and second directions and including an abutting surface abutting against the end of the sheet;

a bias member configured to bias the abutment portion toward the first direction; and a second restricting portion configured to restrict a movable range of the abutment portion from a first movable range in a state in which the holding portion is restricted by the first restricting portion to a second movable range in a state in which the restriction of the holding portion is released by the releasing portion, the second movable range being narrower than the first movable range.

2. The sheet stacking apparatus according to claim 1, wherein the holding portion includes a counterface surface facing the end of the sheet stacked in the sheet stacking member, and wherein the second movable range is set such that an end position of the second movable range in the second direction is located forward in the first direction of an end position of the first movable range in the second direction, and at least a part of the abutting surface is located forward in the first direction of the counterface surface of the holding portion at the end position of the second movable range in the second direction.

3. The sheet stacking apparatus according to claim 2, wherein the holding portion is configured to store the abutment portion inside thereof, and wherein the abutment portion is movable in the second direction until the abutting surface restricts the end of the sheet together with the counterface surface of the holding portion in the first movable range and the move of the abutment portion in the second direction is restricted by the second restricting member at a position where at least a part of the abutting surface projects out of the counterface surface in the first direction in the second movable range.

4. The sheet stacking apparatus according to claim 1, wherein the first restricting portion includes an engaging portion attached to the holding portion such that the engaging portion is positioned rearward the abutment portion in the first direction to face to the abutment portion and is movable from an engage position where the engaging portion engages to an engaged portion provided in the sheet stacking member to a disengage position where the engagement with the engaged portion is released by a releasing operation of the releasing portion; and wherein the second restricting portion includes an interference portion provided integrally with the engaging portion and limiting the movable range of the abutment portion to the second movable range by interfering with the abutment portion in a state in which the engaging portion is located at the disengage position.

5. The sheet stacking apparatus according to claim 4, wherein the abutment portion includes a first projecting portion projecting in the second direction on a back surface of the abutment portion opposite from the abutting surface; and wherein the interference portion includes a second projecting portion projecting in the first direction at a position facing the first projecting portion in a state in which the engaging portion is located at the disengage position.

6. The sheet stacking apparatus according to claim 5, wherein the engaging portion includes a concave space in the second direction with respect to the second projecting portion at a position facing the first projecting portion in a state in which the engaging portion is located at the engage position.

7. The sheet stacking apparatus according to claim 1, wherein the releasing portion includes a lever member attached to the holding portion such that the lever member is positioned rearward, in the first direction, of the abutment portion to face to the abutment portion and is turnable with respect to the holding portion;

wherein the first restricting portion includes an engaging portion being movable from an engage position where the engaging portion engages with an engaged portion provided on the sheet stacking member to a disengage position where the engagement of the engaging portion with the engaged portion is released based on a turning operation of the lever member; and wherein the second restricting portion includes an interference portion provided integrally with the lever member and limiting a movable range of the abutment portion to the second movable range by moving to an interference position where the interference portion interferes with the abutment portion by the turning operation of the lever member.

8. The sheet stacking apparatus according to claim 7, wherein the interference portion includes a first lever projection formed projectively in the first direction at an upper part of the lever member more than a center of a turn of the lever member and a second lever projection formed projectively in the first direction at a lower part of the lever member more than the center of a turn of the lever member.

9. The sheet stacking apparatus according to claim 1, wherein the sheet stacking member includes a sheet stacking portion turning in a vertical direction and stacking the sheet thereon.

10. The sheet stacking apparatus according to claim 9, wherein the second direction is a horizontal component direction of a direction in which the sheet stacked on the sheet stacking portion slides along the inclination of the sheet stacking portion when the sheet stacking portion is turned upward and the first direction is a direction opposite from the second direction.

11. The sheet stacking apparatus according to claim 10, wherein the abutment portion is supported by the holding portion turnably in the first and second directions.

12. The sheet stacking apparatus according to claim 11, wherein the first restricting portion includes an engaging portion attached to the holding portion movably in the vertical direction rearward, in the first direction, of the abutment portion, and engages to an engaged portion provided in the sheet stacking member, and wherein the releasing portion includes a lever member provided turnably with respect to the holding portion rearward of the abutment portion in the first direction, and an interlocking portion configured to convert a direction of an action of a turning force of the lever member upward to transmit the turning force to the engaging portion and moving the engaging portion upward from the engage position where the engaging portion engages with the engaged portion to the disengage portion where the engagement of the engaging portion with the engaged portion is released.

13. A sheet feeding apparatus comprising:

the sheet stacking apparatus as set forth in claim 1; and a sheet feeding portion configured to feed the sheet stacked in the sheet stacking apparatus, wherein the abutment portion abuts against a rear end of the sheet in a sheet feeding direction.

14. The sheet stacking apparatus according to claim 13, wherein the first direction is the sheet feeding direction and the second direction is a direction opposite from the sheet feeding direction.

15. An image forming apparatus comprising:

an image forming portion configured to form an image on a sheet; and a sheet feeding apparatus as set forth in claim 13 configured to feed the sheet to the image forming portion.

* * * * *